US006554199B1

(12) United States Patent
Flessner et al.

(10) Patent No.: US 6,554,199 B1
(45) Date of Patent: Apr. 29, 2003

(54) TRACKWAY FOR TRANSRAPID

(75) Inventors: Hermann C. Flessner, Hamburg; Rolf J. Werner, Munich; Winfried Mohr, Neumarkt, all of (DE)

(73) Assignee: Pfleiderer Infrastrukturtechnick GmbH & Co., KG, Neumarkt (DE)

( * ) Notice: Subject to any disclaimer, the term of this patent is extended or adjusted under 35 U.S.C. 154(b) by 177 days.

(21) Appl. No.: 09/680,712

(22) Filed: Oct. 6, 2000

(51) Int. Cl.[7] ..... E01B 3/14
(52) U.S. Cl. ..... 238/115
(58) Field of Search ..... 238/115, 2, 6, 238/7; 104/124

(56) References Cited

U.S. PATENT DOCUMENTS 5,027,713 A * 7/1991 Kindmann et al. ..... 104/124
5,231,931 A * 8/1993 Sauvageot ..... 104/124
5,850,794 A * 12/1998 Raschbichler et al. ..... 104/281

FOREIGN PATENT DOCUMENTS

DE 4115936 11/1992
DE 19619866 11/1997
DE 29809580 8/1998

* cited by examiner

*Primary Examiner*—S. Joseph Morano
*Assistant Examiner*—Robert J. McCarry, Jr.
(74) *Attorney, Agent, or Firm*—Jordan and Hamburg LLP

(57) ABSTRACT

Trackway for land traffic vehicles, preferably for magnetic levitation tracks, with pre-assembled trackway beams arranged on substructures produced by in situ concrete construction or pre-assembled construction. The trackway beams include one or more hollow, reinforced longitudinal pre-stressed concrete beams and trackway panels, which extend transversely to the pavement and protrude on both sides beyond the pre-stressed concrete beams. The trackway panels are separate components from the concrete beams. The concrete beams are constructed as pre-stressed concrete supporting pipes produced by molding concrete by centrifugal action and have flat upper supporting shoulders for supporting the trackway panels.

41 Claims, 6 Drawing Sheets

TRACKWAY FOR TRANSRAPID

BACKGROUND OF THE INVENTION

Figure 1:
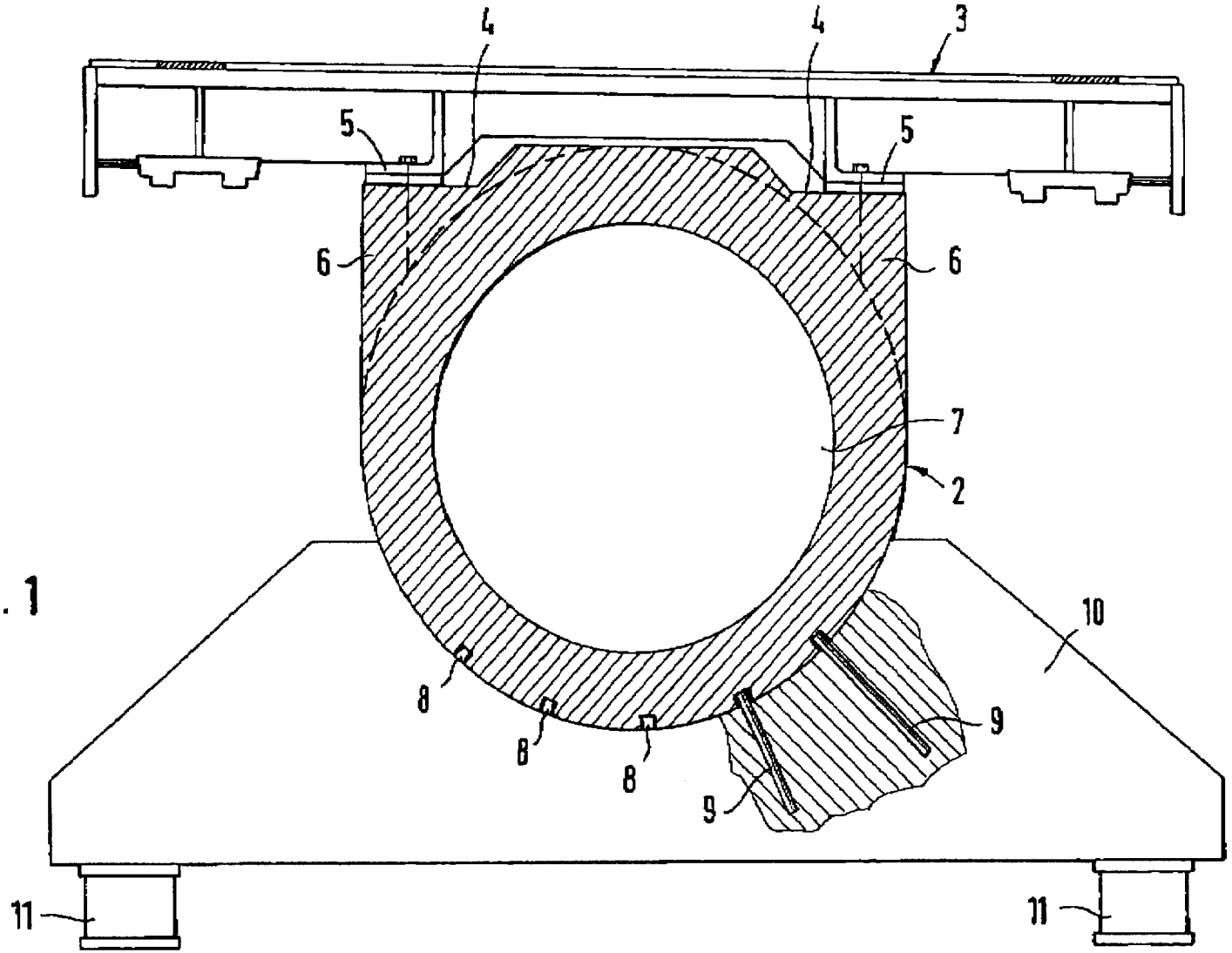

The invention relates to a trackway for land traffic vehicles, preferably for magnetic levitation tracks, such as TRANSRAPID, with pre-assembled trackway beams, which are disposed on substructures produced by in situ concrete construction or pre-assembled construction and have at least one hollow, reinforced longitudinal pre-stressed concrete beam and trackway panels, which extend transversely to the pavement, protrude on both sides beyond the pre-stressed concrete longitudinal beam and are produced as separate components.

Such a trackway is known from German Patent Publication No. DE 298 09 580 U1 in which the trackway longitudinal beams consist of steel.

Similarly to the steel construction, which has also been proposed but is disadvantageous because of the corrosion susceptibility and the increased noise emission and its resulting disadvantageous effect on the surroundings, other previous pre-assembled concrete trackway supports are basically constructed so that a hollow, reinforced pre-stressed concrete longitudinal beam is provided with a trapezoidal cross section, the upper larger base leg of which is extended left and right. A trackway support of this type is shown in German Patent Publication No. DE 41 15 936 A1. Usually, the extension is designed as far as the total width of the trackway, so that only the trackway-side components of the supporting and guiding system of the trackway (side guiding rails, gliding ledges and stator packages) have to be mounted.

Such a pre-stressed concrete longitudinal beam can be produced reasonably economically only as a shaken molded concrete part, which makes a fanned out reinforcement necessary, particularly at the ends. This in turn requires practically a complete cross section in the end region for accommodating the reinforcing steel, and wall thicknesses of at least 30 to 40 cm are required also in the hollow and middle regions, in order to ensure the required strength in the shaken concrete construction. These difficulties, in principal, also arise in a hybrid construction, for which the lateral arms of the pre-stressed concrete longitudinal beams are not designed for the full width of the trackway and, instead, are shortened somewhat. True to size steel elements are bolted to the shortened arms in an expensive manner and, in turn, form or hold the trackway-side components of the supporting and guiding system. Here also, the pre-stressed concrete longitudinal beam with the shortened arms must be produced by shaking in a mold; once again, this is associated with the difficulties with the increased weight described above. Such an increased weight is undesirable not only with respect to be increased material costs, but particularly also because of the difficulty of handling the pre-assembled parts during the installation at the construction site.

SUMMARY OF THE INVENTION

It is therefore an object of the invention to configure a trackway for magnetic levitation tracks of the type named above in such a manner, that the pre-stressed longitudinal beams can be produced more easily, less expensively and with lesser wall thicknesses and therefore a lesser weight.

In accordance with the invention, this objective is accomplished by constructing the pre-stressed concrete longitudinal beam or beams as pre-stressed concrete pipes, produced by molding concrete by centrifugal action and with flat upper supporting shoulders for the trackway panels.

By separating the beam element from trackway panels, which can be made from reinforced concrete as well as from steel plate, that is, by doing without concreting the supporting legs for the trackway laterally to the pre-stressed concrete longitudinal beams, the pre-stressed concrete longitudinal beam can be produced as an essentially tubular, symmetrical component, which has been molded by centrifugal action. Not only is it possible to produce thinner walls when employing the centrifugal technique for producing the beam, but a continuously hollow supporting beam is obtained in this manner, which offers a large continuous space for laying cables and supply pipelines. Moreover, the supporting shoulders should be formed by reinforcing ribs protruding laterally beyond the essentially cylindrical tubular shape. These reinforcing ribs cannot be compared with the flanges of the previous trackway beams, which protrude more by an order of magnitude. Due to these protruding ribs for achieving a somewhat larger supporting surface, the imbalance of the beam, which can, as will still be discussed further below, be compensated for further during the manufacturing process by other measures, can be kept small enough so that a simple centrifugal concrete manufacturing process is possible.

In contrast to constructions with pre-assembled trackway beams about 20 m to 31 m long, the trackway panels, in a further development of the invention, are to consist of a plurality of spaced-apart individual trackway panels, which are short in the direction of the trackway, preferably being about 6 m in length. These panel segments can be exchanged significantly more quickly and dismantled individually from the type beams for maintenance and repair. They are therefore repair friendly, especially when produced from steel plate in the preferred construction. In contrast to the existing trackway panels, which are concreted on directly, they are milled easily in machines and therefore can be machined accurately. In much the same way as with the existing beam joist systems, the individual panels for forming a trackway panel can be bolted easily and permanently to the pre-stressed concrete supporting pipes. It should be emphasized as a further advantage that the individual panels can be mounted accurately.

The division of the trackway panel of a pre-assembled trackway beam, which is about 20 m to 31 m in length, into a plurality of individual panels thus has the advantage of a simpler and also more accurate machining of these individual panels and an easier handling. Moreover, the division of the trackway panel into individual panels offers the advantage that a simpler transverse inclination of the trackway can be achieved in curves and, in particular, the transition regions between the sections of different inclination can be configured more simply.

The large temperature differences generally occurring in trackway beams (at the top, the trackway panel becomes hot due to the incident sunlight, while the pre-stressed concrete longitudinal beam underneath is in the shade and therefore remains cool) and the high stresses resulting therefrom can be intercepted better by trackway panels, which are bolted on and advantageously also divided into individual panels, than by trackway panels, which are connected monolithically with the trackway support. Compared to a steel trackway, which is also lighter in weight and for which the longitudinal beam can also be constructed as a steel beam, the noise resonance behavior of the trackway in accordance with the invention is significantly better and, above all, corrosion protection is not required.

In the case of an elevated trackway, for which so-called A supports generally are used, the pre-stressed concrete supporting pipe, which is disposed centrally to the trackway panel, should be supplied with supporting brackets, which are concreted on subsequently, for resting on the supporting pillars. For this purpose, threaded bushings, into which anchoring rods, protruding into a supporting brackets, can be screwed, may be embedded in the pre-stressed concrete pipes. Moreover, in the region in which they rest on the supporting bracket, the pre-stressed concrete supporting pipes additionally may have a roughened surface, so that by these means also a better connection between the pre-stressed concrete supporting pipe and the supporting bracket is ensured.

To camber the trackway laterally in curved sections, intermediate wedges can be introduced between the supporting shoulders of the pre-stressed concrete pipes and the trackway panels or, especially when the cambering is extensive in curved sections, the pre-stressed concrete supporting pipes can also be concreted in a twisted manner to the supporting bracket.

The inventive development of a trackway with pre-stressed concrete pipes, produced by centrifugal action, can also be used outstandingly in the case of a trackway at ground level. For this purpose, either a continuous central supporting wall or a plurality of relatively closely spaced transverse supporting walls (at a distance of 3 to 5 meters from one another), placed transversely to the trackway and on which the pre-assembled trackway beams rest, have been used in the past. A projection of about 80 to 100 cm above the ground is required even in the case of so-called ground level trackways because the Transrapid carriage construction overlaps the side walls of the trackway. Aside from the increased costs resulting from the arrangement of the transverse supports at short intervals and the need to anchor the transverse supports deep in the ground because of the high weights, this construction also leads to high, annoying noise (a loud rattling noise) as a result of the constant air turbulences, for example, at the transverse supporting wall, caused by the high driving speeds.

In order to avoid this, provisions have been made pursuant to the invention in the case of a ground level trackway that two parallel spaced-apart pre-stressed concrete supporting pipes, which are connected with one another in the supporting region and jointly carry the trackway panel, which is manufactured as a separate component, preferably in the form of individual panel segments, are supported directly on the ground bedplate. For this purpose, in addition to having upper supporting shoulders, the pre-stressed concrete supporting pipes should be provided with lateral flattenings, so that, at a height of about 80 cm, in spite of being disposed next to and at a distance from one another, they only have a total width, which is clearly less than the width of the trackway.

Aside from the advantages with respect to the noise development, which have already been addressed above, the inventive construction from centrifugally produced, pre-stressed, mutually connected, rectangular pipes with a height of 60 to 80 cm, which are supported directly on the ground bedplate, has the advantage that far fewer bedplates per segment unit are required. Previously, it was necessary to provide three bedplates per trackway panel of 6.20 m. On the other hand, for the inventive construction, two bedplates, disposed at the end side, suffice for the total length of the pre-stressed concrete supporting pipes of 20 m to 31 m. This denotes a considerable simplification in the construction of the trackway.

Moreover, the free space between the centrifugally produced rectangular pipes is suitable for accommodating cables and supplying pipelines in a protected manner. Particularly advantageously, the pre-stressed concrete supporting pipes, constructed essentially as rectangular pipes, can be bolted in the supporting region to a steel frame, which is constructed as a rectangular profile and, in turn, bolted to the ground bedplates.

In the case of a ground level trackway with the inventive, centrifugally produced, pre-stressed concrete rectangular pipes placed on edge, the latter can be supported at the ground bedplate over a wedge intermediate support, so that it is not necessary to have special trackway supports for each slope, which would then, in turn, require special centrifugal molds.

In order to avoid the disadvantageous effect of sagging of the pre-assembled trackway supports, placed cantilevered over large sections, the pre-stressed concrete supporting pipes can be manufactured with a slight curvature upward in such a manner that, in the supported state, because of their own weight and the weight of the trackway panel placed upon them, they assume a precisely horizontal, flat position. On the other hand, the upward curvature can be dimensioned so that the horizontal position is achieved even under the load of traffic.

Moreover, for absorbing the high vehicle weight in the lower section of the pre-stressed concrete supporting pipes, there may be a strengthened reinforcement of thicker and/or more tightly packed pre-stressing steel in these regions.

To produce the pre-stressed concrete supporting pipe in accordance with one embodiment of the invention, a centrifugal concrete mold is provided, for which the mold plate, which determines the outer shape of the pre-stressed concrete supporting pipe, is provided with supporting ribs, disposed asymmetrically about the axis of rotation such that the imbalance, resulting from the increased proportion of concrete in the region of the supporting shoulders, is compensated for by these means in conjunction with the asymmetrically distributed pre-stressing steel. By means of this automatic compensation of the imbalance, which is possible, of course, only because the trackway panels are not integrally molded directly to the trackway supports and, instead, are fastened as individual components to the pre-stressed concrete supporting pipes produced from centrifugal concrete, the production of the centrifugal concrete can be realized very rationally and also with correspondingly high rotational speeds and therefore with a high concrete density and a correspondingly lower wall thickness.

Further advantages, distinguishing features and details of the invention arise out of the following description of some examples, as well as from the accompanying drawings.

IN THE DRAWINGS

Figure 2:
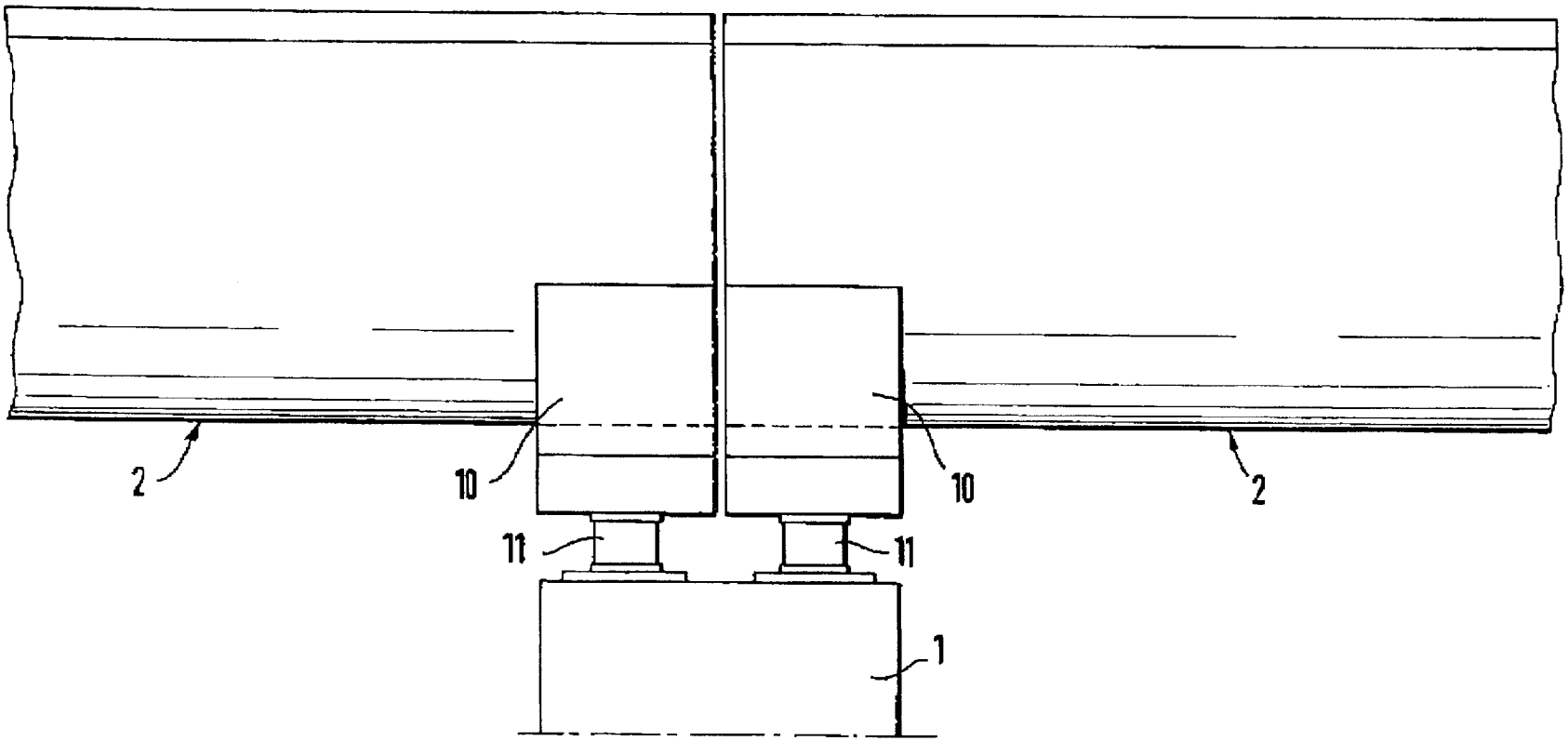
Figure 3:
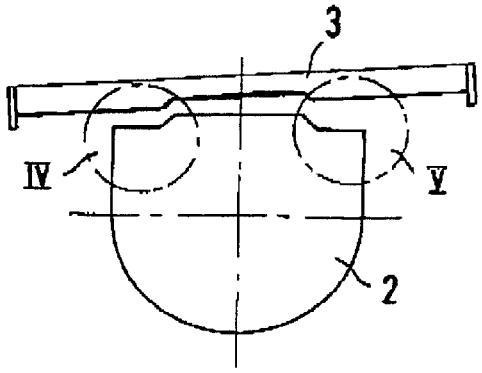
Figure 6:
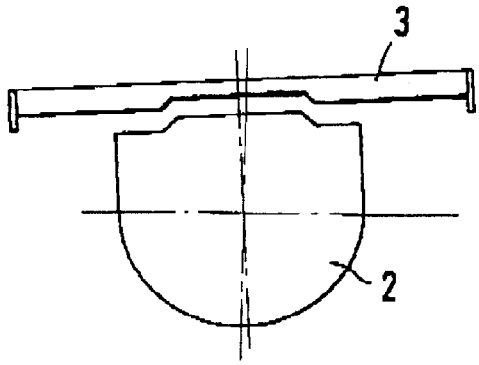
Figure 4:
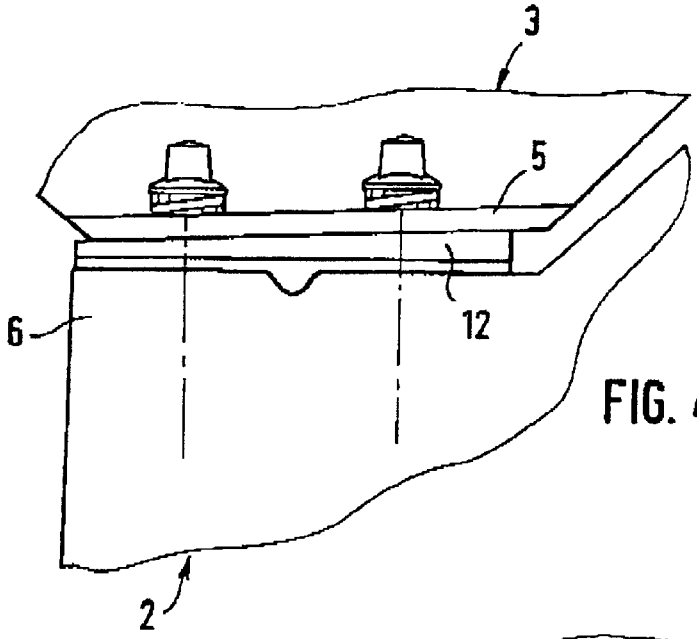
Figure 5:
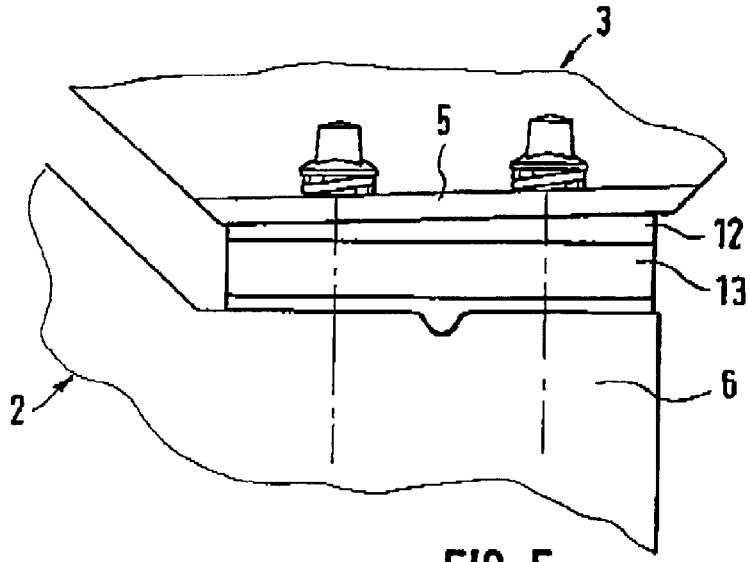
Figure 7:
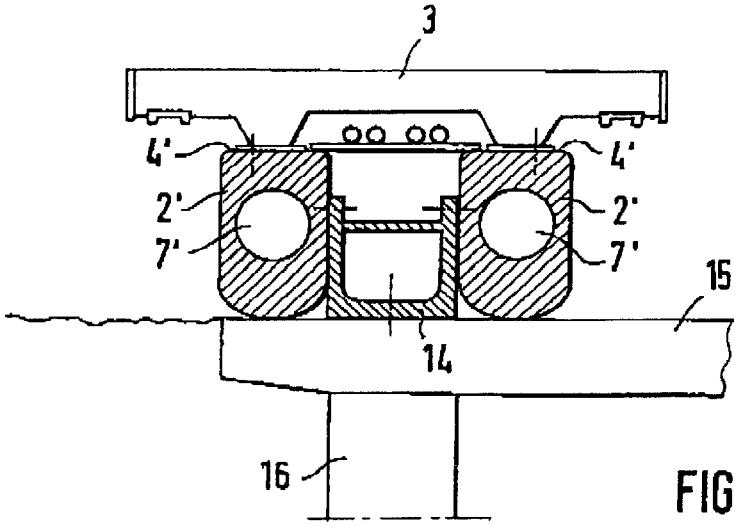
Figure 8:
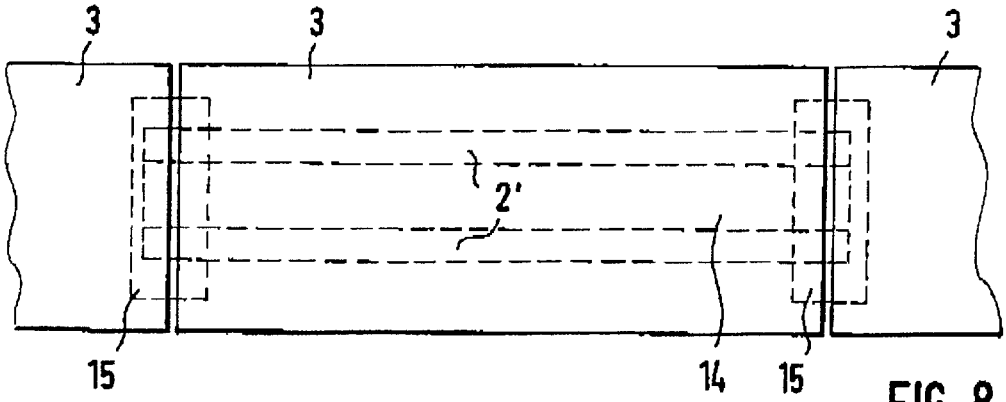
Figure 9:
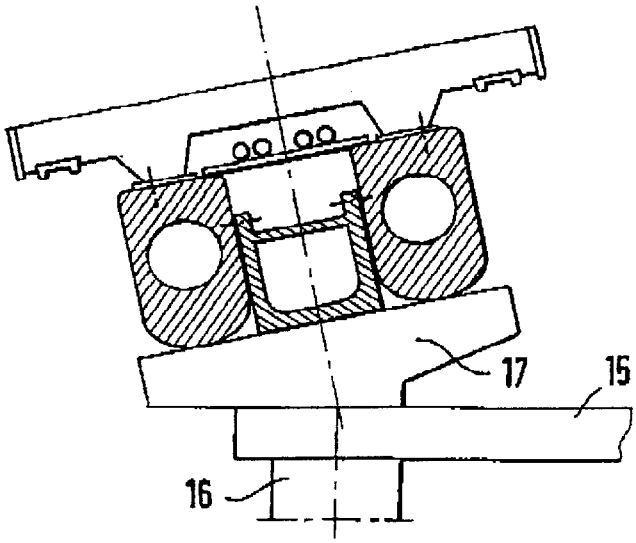
Figure 10:
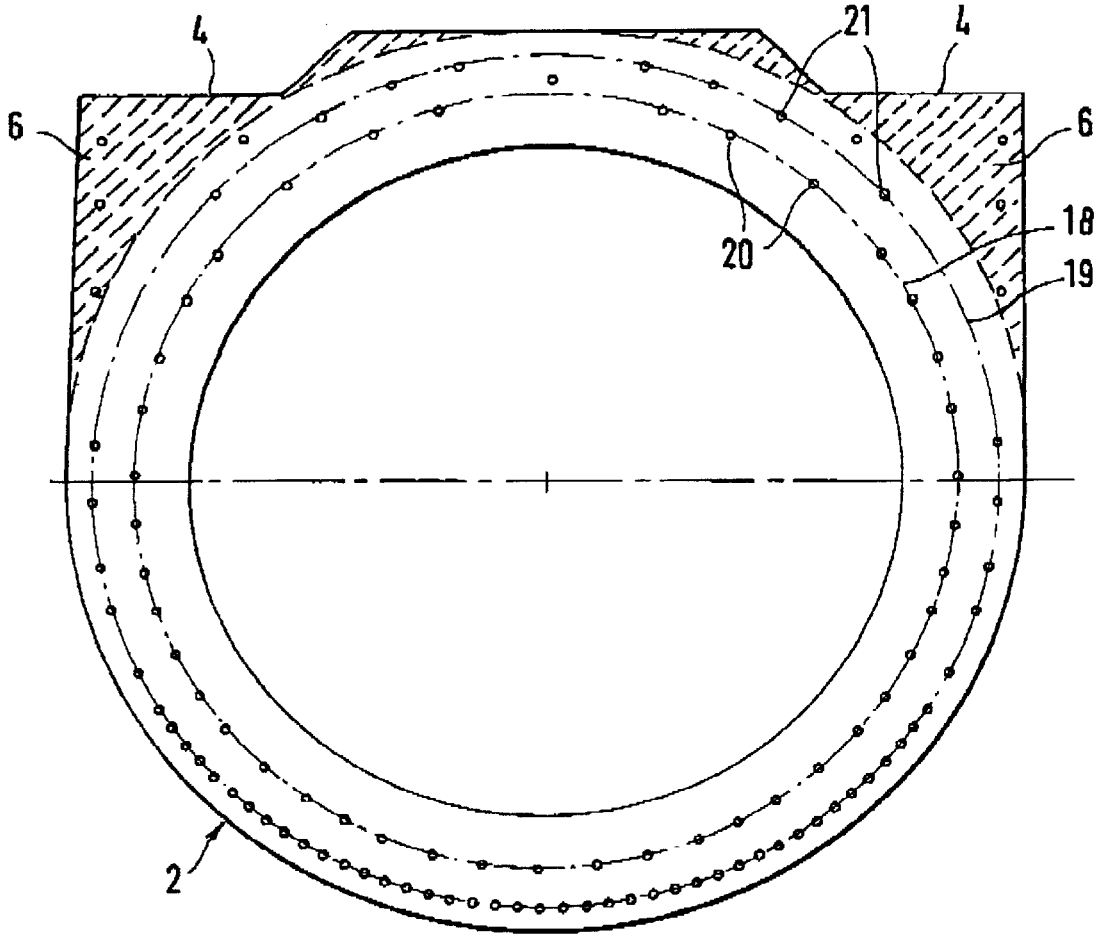
Figure 11:
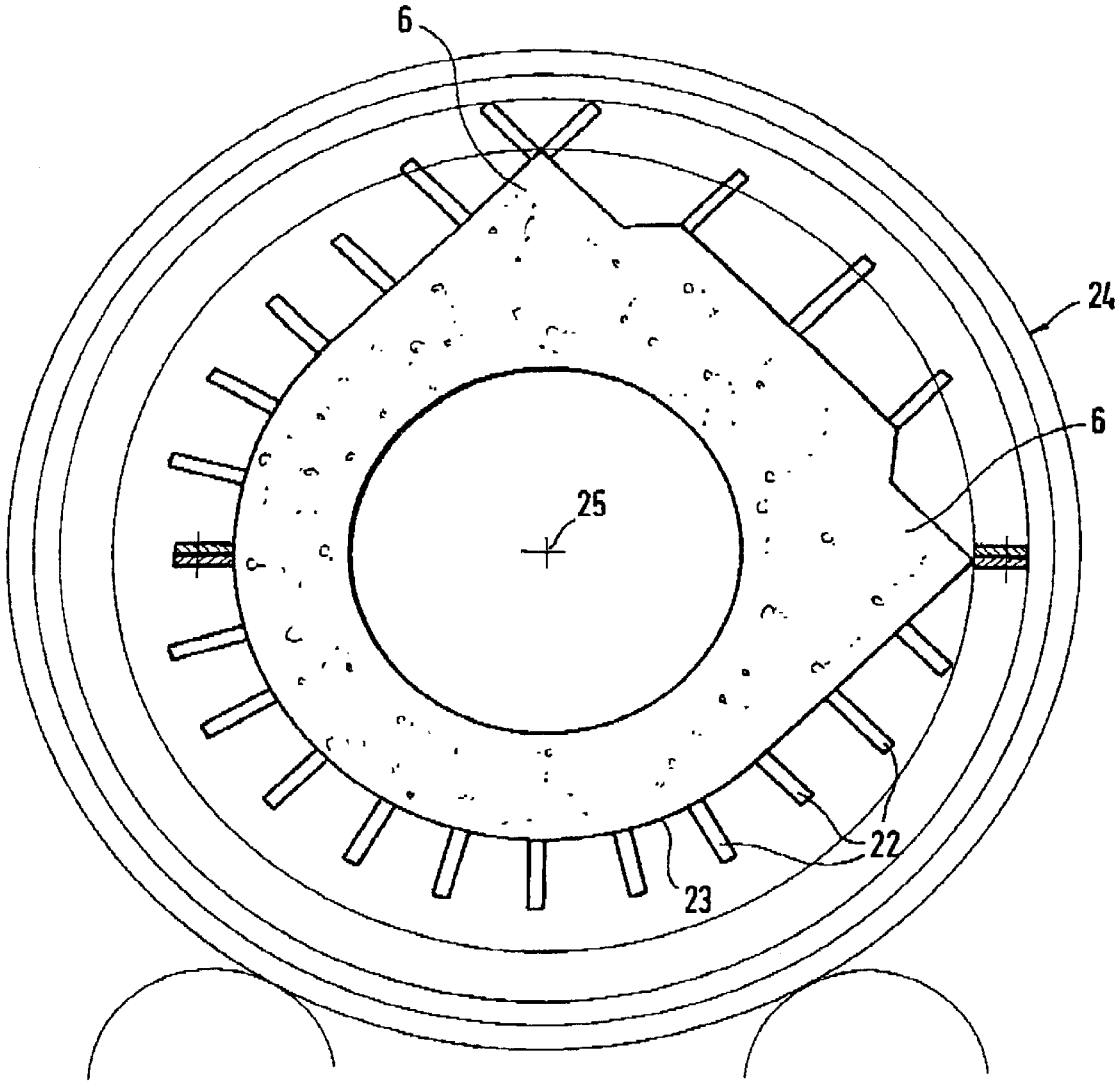

FIG. 1 shows a section through pre-assembled trackway beam in accordance with one embodiment of the invention, FIG. 2 shows a side view of a trackway in the region of contact between two pre-assembled trackway beams of FIG. 1 without the trackway panels, FIG. 3 shows a diagrammatic sectional representation of a vehicle with a laterally cambered trackway in the curve region, FIGS. 4 and 5 show enlargements of the sections IV and V in FIG. 3 with the construction of the wedge support of the trackway panel on the pre-stressed concrete supporting pipe, FIG. 6 shows a diagrammatic representation, corresponding to FIG. 3, for which the lateral cambering in the curve is achieved by additionally twisting the pre-stressed concrete supporting pipe, FIG. 7 shows a section through a ground level trackway with two centrifugal pre-stressed concrete supporting pipes, which are connected with one another and formed essentially as rectangular pipes, FIG. 8 shows a plan view of a section of the trackway of FIG. 7, for which several trackway panels rest on two rectangular pipes, FIG. 9 shows a section, corresponding to FIG. 7, through the trackway in the region of a cambered curve, FIG. 10 shows as enlarged section through a pre-stressed concrete supporting pipe, in which the pre-stressing reinforcement is indicated, and FIG. 11 shows a diagrammatic section through a centrifugal mold for producing a pre-stressed concrete supporting pipe of FIG. 10.

DESCRIPTION OF THE PREFERRED EMBODIMENT

The trackway for an elevated trackway construction, which is shown in FIGS. 1 and 2, and the support 1 of which, which is several meters high, is merely indicated in FIG. 2 and left out completely in FIG. 1, consists essentially of a pre-stressed concrete supporting pipe 2 and the trackway panels 3, which are manufactured as separate components. The trackway panels 3 are not constructed in the same length as the pre-stressed concrete supporting pipe 2. Instead, they are produced from individual panels with a correspondingly shorter length. This makes possible a considerably simpler processing of the trackway panels independently of whether these trackway panels 3 are manufactured as reinforced concrete panels or, as shown, as a steel plate construction. In particular, however, because the trackway panels and the actual longitudinal support are completely separate, it becomes possible to construct the longitudinal beam as an at least approximately symmetrical pipe and, with that, as a pipe showing only little imbalance, which consequently can be produced as a centrifugal concrete pipe. Frequently, the whole of the pavement of the trackway panel 3, together with the bearing longitudinal pipe, which generally had a trapezoidal cross-section that was wider at the top, was constructed as a one-piece component, which makes a meaningful centrifugal concrete construction almost impossible. Moreover, this component, independently of the way in which it was manufactured, had to be handled in every case as a whole. The high weight because of the increased wall thicknesses of the shaken pre-stressed concrete longitudinal beam, in conjunctio wit th weight o th trackway panels fastened thereto in one piece, make the placement of such pre-assembled trackway beams with an overall length of about 20 m to 31 m and the achievement of precision in the surface of the trackway panels highly complicated installation processes.

For forming supporting shoulders 4, to which corresponding bearing surfaces 5 of the trackway panels 3 can be bolted, only reinforcing ribs 6, which protrude slightly over the cylindrical tubular shape of the pre-stressed concrete supporting pipe 2, are required. Such reinforcing ribs 6 are not associated with any imbalance worth mentioning, in any case, not with any imbalance and asymmetry, which would stand in the way of manufacturing the concrete pipe by centrifugal action.

The manufacture of the concrete pipe by centrifugal action results in a continuous, large, internal cavity 7, which can be used to lay cables and supply pipelines. During the manufacture of the pre-stressed concrete pipe 2 by centrifugal action, threaded bushings 8, into which anchoring rods 9 can be screwed, are inserted in the supporting region on the pillars 1, that is, generally in the end regions at the pre-stressed concrete supporting pipes, which are 20 m to 31 m long. These anchoring rods 9 serve to anchor the supporting brackets 10, with the help of which the pre-stressed concrete supporting pipe 2 with the trackway panels 3 is supported on the supports 1. The additionally provided, preferably spring-suspended supporting feet 11 are known and therefore need not be described in greater detail here. The separation of the trackway panels from the pre-stressed concrete supporting pipes 2 makes a very simple trackway cambering possible in curves, as shown in FIGS. 3 to 5. For this purpose, it is only necessary to interpose wedge plates 12 and an additional spacer plate 13 in the fastening region of the trackway panel 3 at the supporting pipe 2. Instead of or optionally also in addition to this, the pre-stressed concrete supporting pipe, as shown in FIG. 6, can also be twisted about its longitudinal axis, that is, for example, concreted or in a correspondingly twisted fashion to the bracket 10. The divided construction of the trackway panels as individual short panels, especially in the case of this trackway camber of FIGS. 3 to 5, is of particular advantage since by these means the inclination need not to be constant within a pre-assembled beam support having a length of 20 m to 31 m. Instead, the individual panels of in each case about 6.20 m can have different slopes.

FIGS. 7 and 8 diagrammatically show a plan view and a section through a ground level trackway. One or more trackway panels 3, about 6.20 m in length, can be seen here. They are supported directly on the ground bedplate 15 over two pre-stressed concrete pipes 2', which are spaced apart parallel to one another and bolted together at the bearing surface by a rectangular steel pipe 14. The ground bedplate 15, which can additionally be provided with anchoring pillars 16, need only be provided at a distance, which corresponds to the length of a pre-assembled trackway beam, that is, in the example shown, to a length of about 20 m to 31 m. On the other hand, for supporting the pre-assembled trackway beams with the help of transverse supporting walls disposed at 3 m intervals, almost ten times as many bedplates were required. Aside from the internal, continuous cavity 7' of the pre-stressed concrete supporting pipes 2', which are constructed essentially as rectangular pipes, especially also the space between the pre-stressed concrete and the rectangular beams is suitable for accommodating cables and supply pipelines.

In FIG. 9, a section corresponding to FIG. 7 is shown. An inclination of the trackway as a curve camber is achieved by a wedge plate 17, placed on the bedplate 15.

FIG. 10 shows an enlarged section through a pre-stressed concrete supporting pipe 2, in which also the pre-stressing steel, disposed in different circular cylindrical planes 18 and 19, is indicated. The pre-stressing steel is packed more tightly and, optionally is also constructed thicker in the lower half of the pre-stressed concrete supporting pipe 2 remote from the supporting shoulders 4, in order to achieve increased reinforcement in this lower region, which is stressed in tension particularly heavily due to the weight imposed. This asymmetric distribution of the reinforcement, in conjunction with an asymmetric distribution of the supporting ribs 22, can be utilized for stiffening the mold plate 23 within a centrifugal concrete mold 24 of FIG. 11 so that the increased steel weight in the lower region of the pre-stressed concrete supporting pipe, which is to be produced, compensates for the increased weight of the concrete in the region of the supporting shoulders and the protruding reinforcing ribs 6, so that an imbalance is avoided and consequently the manufacture of centrifugal concrete in a particularly simple manner and with particularly high rotational speeds is possible.

What is claimed is:

1. A trackway for land traffic vehicles, comprising:

at least one hollow, reinforced longitudinal pre-stressed concrete beam having flat upper supporting shoulders, said at least one concrete beam being constructed as a pre-stressed concrete supporting pipe by molding concrete by centrifugal action; and trackway panels separable from said at least one concrete beam and supported on said shoulders of said at least one concrete beam, said trackway panels defining a track support surface, each of said trackway panels being arranged to transversely overlie said at least one concrete beam and project over both lateral edges of said at least one concrete beam.

2. The trackway of claim 1, wherein said at least one concrete beam has a generally cylindrical, tubular central portion, said supporting shoulders of said at least one concrete beam being formed by reinforcing ribs protruding laterally over said cylindrical tubular portion of said at least one concrete beam.

3. The trackway of claim 1, wherein said trackway panels are reinforced concrete panels.

4. The trackway of claim 1, wherein said trackway panels are made of steel plates.

5. The trackway of claim 1, wherein said trackway panels have a length smaller than a length of said at least one concrete beam such that said at least one concrete beam supports a plurality of said trackway panels, said trackway panels being fastened at a distance from one another on said at least one concrete beam.

6. The trackway of claim 1, further comprising:

supporting pillars adapted to be positioned on ground supports; and supporting brackets connected to said at least one concrete beam for supporting said at least one concrete beam on said supporting pillars.

7. The trackway of claim 6, further comprising:

threaded bushings embedded in said at least one concrete beam; and anchor rods mating with said threaded bushings and engaging said supporting brackets.

8. The trackway of claim 6, wherein said at least one concrete beam has a roughened surface at least in a supporting region in which said at least one concrete beam is supported by said supporting brackets.

9. The trackway of claim 1, wherein said at least one concrete beam comprises two concrete beams parallel to, at a distance from and connected with one another.

10. The trackway of claim 9, wherein said two concrete beams have substantially planar lateral sides.

11. The trackway of claim 10, wherein each of said two concrete beams is a vertically oriented, substantially rectangular pipe.

12. The trackway of claim 9, further comprising a steel frame having a substantially rectangular cross-section and interposed between said two concrete beams, said two concrete beams being attached to said steel frame.

13. The trackway of claim 9, further comprising a concrete bedplate; and a wedge intermediate beam arranged on said concrete bedplate and supporting said two concrete beams on said concrete bedplate.

14. The trackway of claim 9, further comprising a concrete bedplate, said two concrete beams being supported directly on said concrete bedplate.

15. The trackway of claim 1, further comprising wedges arranged between said supporting shoulder of said at least one concrete beam and said trackway panels for enabling a lateral cambering when the trackway is curved.

16. The trackway of claim 1, further comprising supporting brackets connected to and supporting said at least one concrete beam, said at least one concrete beam being concreted, twisted about its longitudinal axis, to said supporting brackets for enabling a lateral cambering when the trackway is curved.

17. The trackway of claim 1, wherein a lower region of said at least one concrete beam opposite from said supporting shoulders includes a strengthened reinforcement of at least one of thicker and more tightly packed pre-stressing steel in comparison to other regions of said at least one concrete beam.

18. The trackway of claim 1, wherein said at least one concrete beam has steel reinforcement ribs having different thicknesses, thicker ones of said ribs being arranged at specific locations to compensate for possible sagging of the mold resulting from non-uniform pre-stressing in the cross-sectional area.

19. The trackway of claim 1, wherein said at least one concrete beam has a cylindrical cavity.

20. The trackway of claim 1, wherein each of said trackway panels has a length smaller than a length of said at least one concrete beam such that each of said at least one concrete beam supports a plurality of said trackway panels.

21. The trackway of claim 1, wherein said at least one concrete beam is substantially cylindrical.

22. The trackway of claim 1, further comprising attachment means for attaching said trackway panels to said supporting shoulders of said at least one concrete beam.

23. The trackway of claim 1, wherein said trackway panels have downward facing bearing surfaces, said bearing surfaces lying over said supporting shoulders of said at least one concrete beam.

24. A mold for producing a pre-stressed concrete supporting pipe having outwardly projecting reinforcing ribs for a trackway, comprising:

a mold plate having the external shape of the pre-stressed concrete supporting pipe;

pre-stressing steel rods distributed asymmetrically in an interior defined by said mold plate; and supporting ribs distributed on said mold plate asymmetrically about an axis of rotation of said mold plate so that, in conjunction with the asymmetric distribution of said pre-stressing steel rods, an imbalance resulting from the increased proportion of concrete in a region of the reinforcing ribs is compensated for.

25. A trackway for land traffic vehicles, comprising:

at least one hollow, reinforced pre-stressed concrete beam having a cylindrical shape and defining a cylindrical cavity, said at least one concrete beam having supporting shoulders extending upward and laterally from outer arcuate surfaces; and trackway panels separable from said at least one concrete beam and supported on said shoulders of said at least one concrete beam, said trackway panels defining a track support surface, each of said trackway panels being arranged to transversely overlie said at least one concrete beam and project over both lateral edges of said at least one concrete beam.

26. The trackway of claim 25, wherein said at least one concrete beam is constructed as a pre-stressed concrete supporting pipe by molding concrete by centrifugal action.

27. A method for constructing a trackway for vehicles, comprising the steps of:

forming pre-stressed concrete supporting beams having outwardly projecting support shoulders at an upper region by creating a mold in the shape of the beams, inserting concrete into the mold and spinning the mold to thereby form the beams by centrifugal action;

forming trackway panels separately from the beams and which define a track support surface; and attaching the trackway panels to the support shoulders of the beams.

28. The method of claim 27, wherein the step of forming the beams comprises the step of forming a cylindrical cavity in the beams.

29. The method of claim 27, wherein the step of forming the beams comprises the step of providing the mold with a substantially cylindrical shape.

30. The method of claim 29, wherein the step of forming the beams further comprises the step of arranging reinforcing ribs to protrude outward from the cylindrical shape of the mold, the support shoulders being defined by the reinforcing ribs.

31. The method of claim 27, wherein the trackway panels are formed with a length smaller than a length of the beams, further comprising the step of attaching a plurality of the trackway panels to each of the beams.

32. The method of claim 27, further comprising the steps of:

attaching support brackets to the beams; and mounting the support brackets on support pillars coupled to the ground.

33. The method of claim 27, further comprising the steps of:

embedding threaded bushings in the beams;

threading anchor rods into the threaded bushings; and engaging the anchor rods with support brackets.

34. The method of claim 27, further comprising the step of arranging a wedge plate between the support shoulders of one of the beams and the trackway panels attached to the support shoulders, the wedge plate having an inclined surface such that an upper surface of the trackways attached to the support shoulders are inclined with respect to the support shoulders.

35. The method of claim 34, further comprising the step of arranging at least one spacer plate having a uniform height between the wedge plate and the support shoulders.

36. The method of claim 27, further comprising the steps of:

arranging two of the beams alongside one another;

arranging a pipe between the two beams; and connecting a lateral side of each of the two beams adjacent the pipe to the pipe.

37. The method of claim 27, further comprising the steps of:

arranging steel rods in the mold in a plurality of cylindrical planes; and packing the steel rods more tightly in a portion of the cylindrical planes which correspond to a lower half of the beams.

38. The method of claim 27, further comprising the steps of:

arranging steel rods in the mold in a plurality of cylindrical planes; and placing thicker steel rods in a portion of the cylindrical planes which correspond to a lower half of the beams.

39. The method of claim 27, further comprising the steps of:

arranging steel rods in the mold in at least one cylindrical plane; and asymmetrically distributing the steel rods to provide for a greater reinforcement in a region of the mold opposite a region of the mold which corresponds to the support shoulders to thereby compensate for the increased weight of concrete at the support shoulders.

40. The method of claim 27, further comprising the steps of:

arranging supporting ribs in connection with the mold for stiffening the mold; and asymmetrically distributing the supporting ribs to compensate for the increased weight of concrete at the support shoulders.

41. The method of claim 27, further comprising the step of forming the trackway panels with downward facing bearing surfaces, the step of attaching the trackway panels to the support shoulders of the beams comprising the step of bolting the bearing surfaces of the trackway panels to the support shoulders.

* * * * *